US012473737B2

(12) United States Patent
Gómez Rojo et al.

(10) Patent No.: US 12,473,737 B2
(45) Date of Patent: Nov. 18, 2025

(54) SYSTEM AND METHOD FOR CONCRETE FORMING

(71) Applicants: TECOZAM USA CORP., Atlanta, GA (US); GRUPO EMPRESARIAL TECOZAM, S.L, Madrid (ES)

(72) Inventors: Rubén Gómez Rojo, Madrid (ES); Carlos Hipólito Fernández, Madrid (ES); David Castuera Pinto, Madrid (ES); Fernando Tapiador Gutiérrez, Madrid (ES)

(73) Assignees: TECOZAM USA CORP; GRUPO EMPRESARIAL TECOZAM, S.L, Madrid (ES)

( * ) Notice: Subject to any disclaimer, the term of this patent is extended or adjusted under 35 U.S.C. 154(b) by 766 days.

(21) Appl. No.: 17/824,221

(22) Filed: May 25, 2022

(65) Prior Publication Data

US 2023/0407652 A1 Dec. 21, 2023

(51) Int. Cl.

| | |
|---|---|
| ***E04G 19/00*** | (2006.01) |
| ***E04G 17/14*** | (2006.01) |
| *E04G 13/02* | (2006.01) |
| *E04G 13/04* | (2006.01) |

(52) U.S. Cl.

CPC ..... *E04G 19/003* (2013.01); *E04G 17/14* (2013.01); *E04G 13/028* (2013.01); *E04G 13/04* (2013.01)

(58) Field of Classification Search

CPC ..... E04G 17/14; E04G 17/002; E04G 13/028; E04G 13/04; E04G 19/003; E01D 21/10; E01D 21/105; E01D 21/14; E01D 21/15; E01D 21/167; E01D 15/127

See application file for complete search history.

(56) References Cited

U.S. PATENT DOCUMENTS

| | | | | |
|---|---|---|---|---|
| 3,595,514 | A | 7/1971 | Sanders | |
| 4,281,615 | A * | 8/1981 | Wilson | B63B 1/107 114/265 |
| 4,853,998 | A * | 8/1989 | Bernard | E01D 15/127 14/2.4 |
| 4,969,789 | A * | 11/1990 | Searle | E04G 21/22 294/81.61 |
| 10,167,181 | B2 * | 1/2019 | Xu | B66F 9/07568 |

(Continued)

FOREIGN PATENT DOCUMENTS

| | | |
|---|---|---|
| DE | 1243711 B | 7/1967 |
| EP | 1384816 A1 | 1/2004 |

(Continued)

OTHER PUBLICATIONS

Translation of JP2001082095 (Year: 2001).*

(Continued)

*Primary Examiner* — Jessica L Laux
(74) *Attorney, Agent, or Firm* — Snell & Wilmer LLP

(57) ABSTRACT

A system and a method for concrete forming uses a self-driven formwork machine. The self-driven machine is provided with a lifting system, for lifting objects from the ground like a rebar reinforcing cage. The present invention avoids the use of cranes, such that construction cost and execution time, are greatly reduced. The present invention is preferably used for constructing a capital or lintel on top of a pillar, although it can also be used for constructing other overhanging concrete structures.

11 Claims, 13 Drawing Sheets

(56) References Cited

U.S. PATENT DOCUMENTS

| | | | | |
|---|---|---|---|---|
| 10,988,916 | B2 * | 4/2021 | Paul | B25J 15/0019 |
| 11,447,020 | B2 * | 9/2022 | Lombardo | B60L 7/10 |
| 2004/0148717 | A1 | 8/2004 | Kornatsky | |
| 2021/0180345 | A1 | 6/2021 | Pietila | |
| 2022/0098017 | A1 * | 3/2022 | Di Florio | B60L 50/15 |

FOREIGN PATENT DOCUMENTS

| | | | |
|---|---|---|---|
| IT | UB201538260 | A1 | 3/2017 |
| JP | 2001082095 | A | 3/2001 |

OTHER PUBLICATIONS

European Search Report for European Patent Application EP 23 175237 date of completion of search Oct. 13, 2023, 11 pgs. in English.

Extended European Search Report in EP patent application 23175237.9 dated Jan. 23, 2024 prepared by the European Patent Office, 11 pages, in English.

Video entitled "Autocimbra Zamora" by author Grupo Tecozam, uploaded Apr. 4, 2022, XP093091571, retrieved from the internet at https://www.youtube.com/watch?v=NIZA3VKIwPk on Oct. 13, 2023, auto-generated transcript porvided, machine translation of transcript provided.

* cited by examiner

SYSTEM AND METHOD FOR CONCRETE FORMING

FIELD OF THE INVENTION

The present invention is directed to a system and a method for concrete forming using a self-driven formwork machine. The self-driven machine is provided with a lifting system, for lifting objects from the ground like a rebar reinforcing cage, such that the use of cranes is avoided, hence, construction cost and execution time, are greatly reduced.

The present invention is preferably used for constructing pillars for highways, in particular for constructing a capital or lintel on top of a pillar, although it can also be used for constructing other overhanging concrete structures.

BACKGROUND

Concrete forming requires the use of formwork including couplable panels and supports that are manually assembled together to configure a mold, inside which concrete is poured. Typically, before pouring concrete, a rebar reinforcing cage is placed inside the mold such that an internally reinforced concrete structure is obtained. Once the concrete is cured, the formwork is disassembled and moved to the next construction site, and the casting process is repeated as many times as necessary. Therefore, formwork forming is a time-consuming and dangerous task, and require excessive manpower for assembling and disassembling the formwork.

In the particular case of constructing overhanging concrete pieces, for example capitals or lintels, large cranes with spreader beams are conventionally used for moving formwork panels and supports, for assembling and disassembling the formwork structure, and in particular for lifting from the ground and positioning the rebar reinforcing cage.

However, the use of cranes is extremely expensive, inefficient and cumbersome, and require extremely well-trained human operators.

The drawings of the U.S. Pat. No. 3,595,514 illustrates the complexity of using cranes with spreader beams, for the construction of large overhanging reinforced concrete pieces.

Furthermore, the use of cranes with requires a large free space around the construction site, for installing the crane on the ground and for moving the crane's arm. However, in some construction works have to be carried out in confined spaces due to the presence of nearby constructions or buildings, for example for constructing a highway in between existing highways, where cranes cannot operate freely.

SUMMARY

In accordance with one or more embodiments of the present invention, an object of the present invention is the provision of an equipment and a methodology for constructing overhanging (cantilevered) concrete structures, preferably capitals, which avoids the use of cranes in order to reduce construction cost and execution time.

A further object of the present invention is the provision of an equipment and a methodology for constructing overhanging (cantilevered) concrete structures, preferably capitals, in narrow spaces confined between nearby highways or buildings, that are not accessible for conventional cranes.

In particular, an aspect of the present invention refers to a formwork system that comprises at least one formwork machine which in turn comprises a formwork supporting structure, at least a self-driven vehicle, and at least an extendable and retractable mechanism mounted on the self-driven vehicle coupled or couplable with the and at least an extendable and retractable mechanism, such that the formwork supporting structure can be raised and lowered above the self-driven vehicle.

The system further comprises a set of formwork panels that can be attached to the formwork supporting structure, to configure a mould having the shape of the concrete piece like a capital to be constructed.

The formwork system further comprises a lifting system supported by the formwork supporting structure, such that, the lifting system is raised and lowered together with the formwork supporting structure. The lifting system is configured for lifting objects from the ground like formwork panels and a rebar reinforcing structure, and for placing the rebar reinforcing cage inside the mould.

In a preferred embodiment, the lifting system comprises a davit operated by a hydraulic cylinder.

Preferably, the extendable and retractable mechanism is configured for raising and lowering the formwork supporting structure with respect to the ground, when the self-driven vehicle rest on the ground. Preferably, the extendable and retractable mechanism is configured for raising and lowering the formwork supporting structure in a vertical direction or in a direction with a vertical component. The formwork supporting structure is raised and lowered right above the self-driven vehicle, preferably along an axis orthogonal to ground and parallel to the axis of the pillar, so that all construction work can be carried out close to the pillar and below the overhanging concrete structure to be constructed, such that, there is no need to invade nearby areas or other adjacent highways.

Preferably, the self-driven vehicle is a tracked vehicle, but other type of vehicles, like wheeled vehicles suitable for this purpose, are also included in this invention.

The formwork supporting structure is fitted with coupling means, configured for coupling the formwork supporting structure with a pillar on which the capital is to be formed. Furthermore, the formwork supporting structure is a self-supporting structure configured to remain coupled by itself with a pillar in a known manner during the time required for the concrete to cure.

Once the formwork supporting structure is attached to a pillar, the extendable and retractable mechanism is uncoupled from the formwork supporting structure, so that, in practise a set of formwork supporting structures can be provided, and one machine formed by the self-driven vehicle and an extendable and retractable mechanism mounted on the self-driven vehicle, can be used to raise and lower the formwork supporting structures when required as the capitals are being constructed.

Preferably, the formwork supporting structure is rotatable above the self/driven vehicle and about an axis orthogonal to the ground. More preferably, the formwork supporting structure and the extendable and retractable mechanism are jointly rotatable about an axis orthogonal to ground.

In a preferred embodiment, the self-driven vehicle has a horizontal platform, and the formwork supporting structure and the extendable and retractable mechanism, are jointly movable, for example rotatable on the self-driven vehicle's platform, in order to be able to get a good balance when the equipment is transported for example on a gondola truck.

In a preferred embodiment, the extendable and retractable mechanism is a scissor lift operated by a hydraulic cylinder. In other preferred embodiments, other types or mechanisms like telescopic hydraulic cylinders, can alternatively be used.

Preferably, the formwork system comprises first and second formwork machines as the one described above, and formwork panels attachable to the formwork supporting structures of the first and second formwork machines, when the first and second formwork machines are coupled to a pillar for forming a capital on top of it. Therefore, the mould is formed by the two formwork supporting structures and the set of formwork panels.

The lifting system comprises a first davit operated by a first hydraulic cylinder supported by the formwork supporting structure of the first formwork machine, and a second davit operated by a second hydraulic cylinder and supported by the formwork supporting structure of the second formwork machine.

Another aspect of the present invention, refers to a method for constructing a capital on top of a pillar installed on the ground. The method comprises the steps of:

- moving first and second formwork supporting structures close to a pillar, for example in a direction transversal to the axis of the pillar and at ground level or close to it,
- coupling first and second formwork structures to each other at ground level, in order to obtain a more stable structure, such that a pillar is in between the first and second formwork structures,
- raising together the first and second formwork supporting structures up to the level of the upper end of the pillar in a direction preferably parallel to the axis of the pillar,
- coupling the first and second formwork supporting structures to the pillar, and
- attaching formwork panels to the first and second formwork supporting structures to configure a mould having the shape of the capital to be constructed.

Preferably the first and second formwork supporting structures, are raised from a self-driven vehicle resting on the ground, and by means of an extendable and retractable mechanism mounted on the self-driven vehicle, such that first and second formwork supporting structures are raised above the self-driven vehicle, and below a cantilevered part of a concrete piece to be obtained.

In the method of this invention, formwork panels and a rebar reinforcing cage are lifted from the ground by means of a lifting system supported by the first and second formwork supporting structures. The lifting system lifts the rebar reinforcing cage above the first and second formwork supporting structures when these are coupled to the pillar, and then places the rebar inside the mould previously formed. Then, fresh concrete is poured inside the mould.

The lifting system can also be used for any other secondary tasks required for the construction of a capital, that would typically involve the use of cranes.

At this stage, the extendable and retractable mechanism used for raising the first and second formwork supporting structures, are uncoupled and moved away with the self-driven vehicle to be used in another pillar.

Once the concrete is cured, the formwork panels are disassembled and the first and second formwork supporting structures are lowered.

Some advantages associated to the formwork system described in this invention, are listed below:

- a formwork is provided that can lift formwork panels and rebar by itself, without the need of using auxiliary cranes for lifting;
- high speed concrete forming work, reduced costs and manpower, and reduced risk of accidents;
- formwork work can be carried out in confined areas between existing nearby structures, where cranes cannot reach;
- formwork work can be carried out right below the cantilevered concrete piece to be formed, without invading surrounding areas;
- a self-driven formwork machine is provided that can move autonomously from one construction site to another below and along a highway trace;
- a self-supporting formwork is provided which transmits forces directly to the crown of a pillar.

BRIEF DESCRIPTION OF THE DRAWINGS

Preferred embodiments of the invention are henceforth described with reference to the accompanying drawings, wherein.

DETAILED DESCRIPTION

Figure 1:
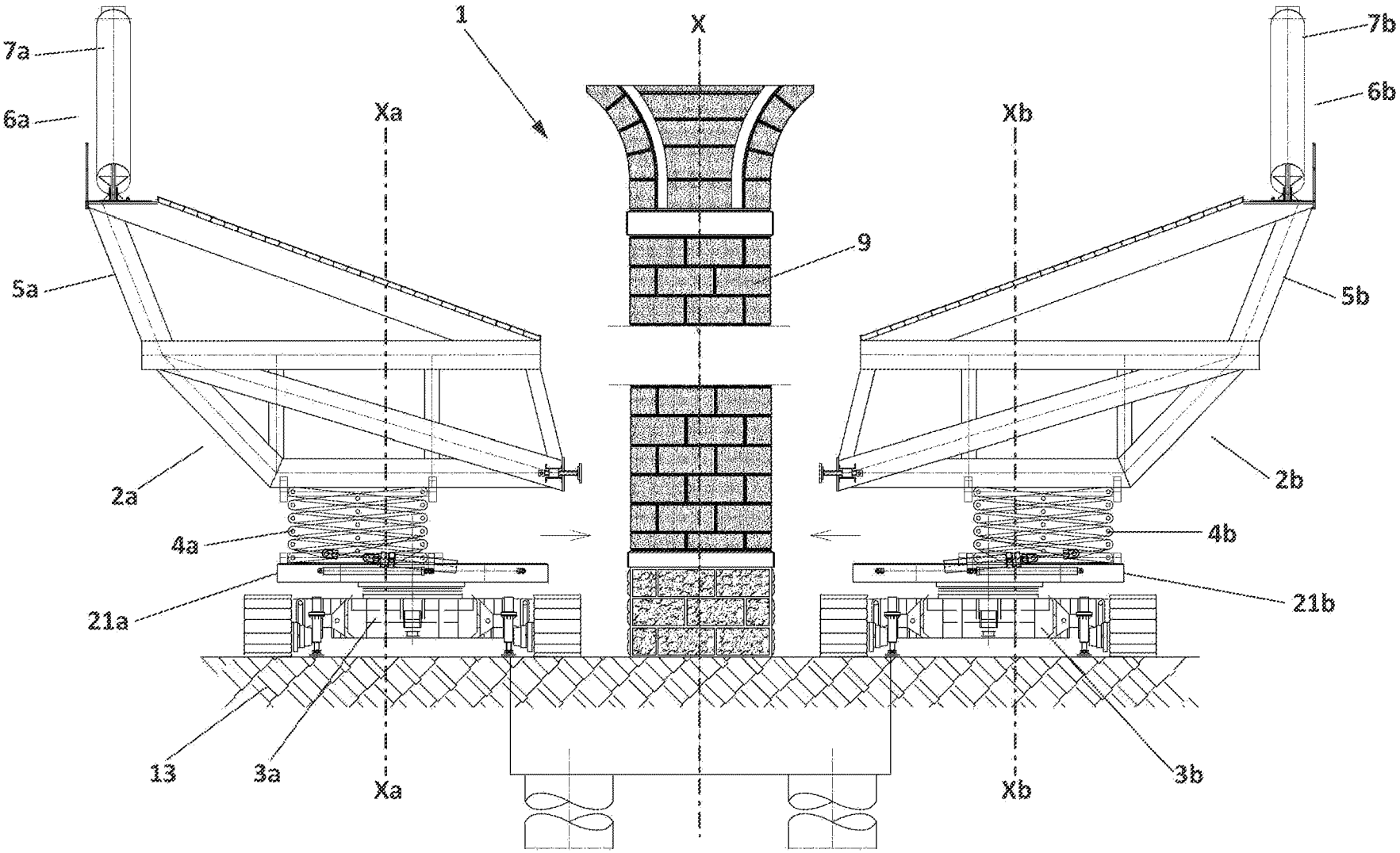
FIG. 1. shows a front elevational view of a formwork system according to the invention, when the formwork machines are shown in a retracted position and prior to their coupling with a pillar.

FIG. 1 shows a formwork system (1) comprising a first formwork machine (2*a*) and a second formwork machine (2*b*), each formwork machine (2*a*,2*b*) comprising a self-driven vehicle (3*a*,3*b*), a vertically extendable and retractable mechanism (4*a*,4*b*) mounted on the self-driven vehicle (3*a*,3*b*), and a formwork supporting structure (5*a*,5*b*) mounted on the vertically extendable and retractable mechanism (4*a*,4*b*), such that the formwork supporting structures (5*a*,5*b*) can be moved vertically above the respective self-driven vehicle (3*a*,3*b*).

Preferably, first and second self-driven vehicles (3*a*,3*b*) in this implementation are tracked vehicles, that do not require rails or conditioned surfaces.

Preferably, first and second extendable and retractable mechanisms (4*a*,4*b*), are configured for vertically raising and lowering first and second formwork supporting structures (5*a*,5*b*) above the self-driven vehicle and along respective axis (Xa,Xb) parallel to the axis (X) of a pillar (9) on top of which a capital (10) is to be constructed.

In the exemplary implementation shown in the figures, first and second extendable and retractable mechanisms (4*a*,4*b*), are scissor-type lift operated by a hydraulic cylinder that perform the vertical movement along axis (Xa,Xb). This extendable and retractable mechanisms (4*a*,4*b*), are capable of elevating the formwork supporting structures (5*a*,5*b*) up to 30 meters above the ground and preferably are remote controlled, such that the formwork supporting structures (5*a*,5*b*) can be easily and rapidly elevated to the required height of each pillar (the height of the pillars varies along the highway trace), and to the curvature of the highway trace, which otherwise would be too slow and complicated using cranes.

In addition, each formwork machine (2*a*,2*b*) is provided with a lifting system (6*a*,6*b*) supported by the respective formwork supporting structure (5*a*,5*b*). Each lifting system (6*a*,6*b*) is configured for lifting objects above the formwork supporting structure (5*a*,5*b*).

In the example shown in the figures, the lifting system (6*a*,6*b*) comprises first and second davits (7*a*,7*b*) articulately attached on top of the formwork supporting structure (5*a*, 5*b*), and operated respectively by first and second hydraulic cylinders (8*a*,8*b*). A transversal beam (16) is supported at its ends by the first and second davits (7*a*,7*b*), and is fitted with motorized hoist (17*a*,17*b*) and the required cables.

Figure 2:
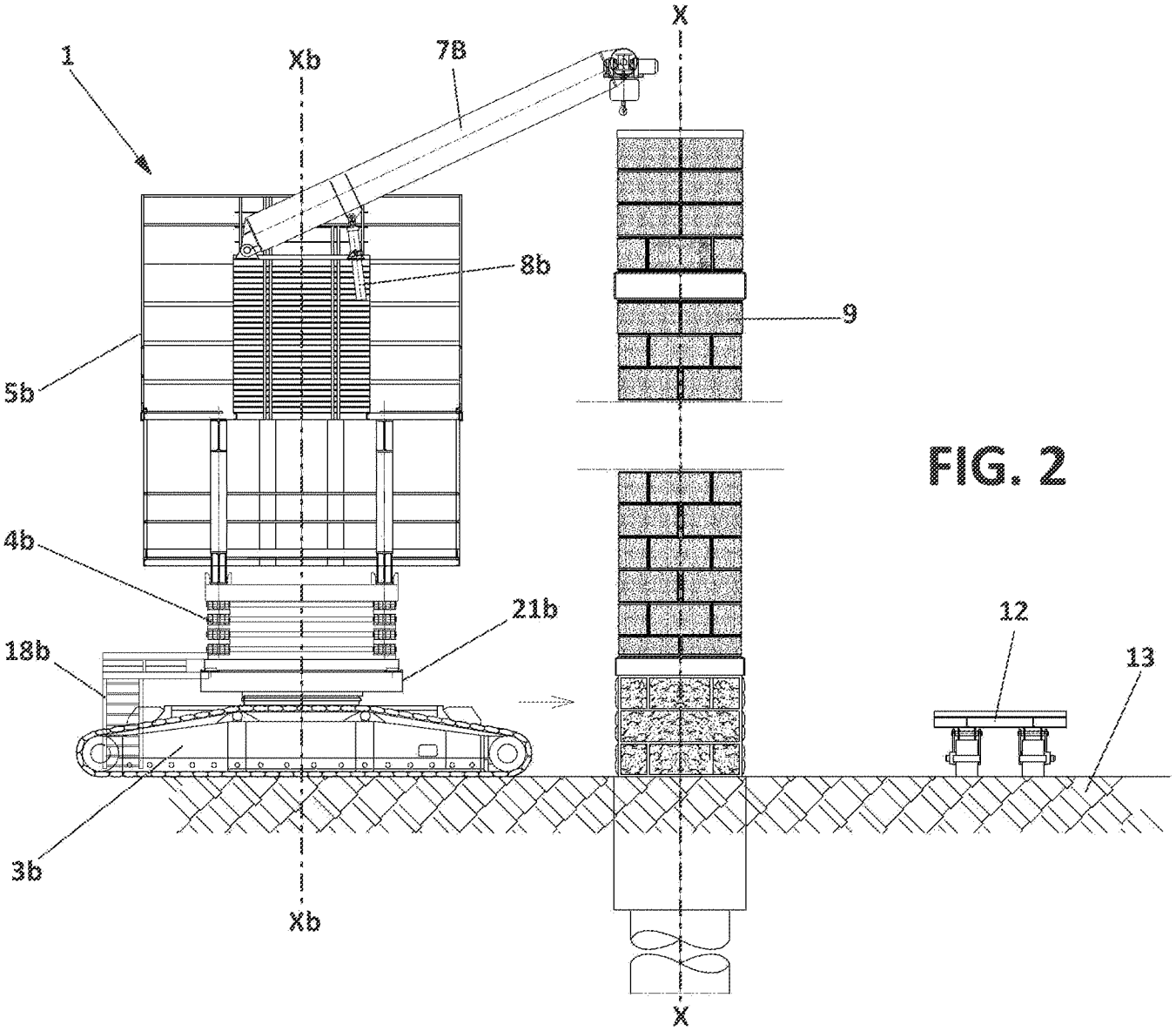
FIG. 2. shows a side elevational view of the representation of FIG. 1.

As it can be observed in FIGS. 1 and 2, the formwork machines (2*a*,2*b*) features a very compact and low profile, such that the machines can move along and below a highway to be constructed or existing and nearby highways.

Figure 3:
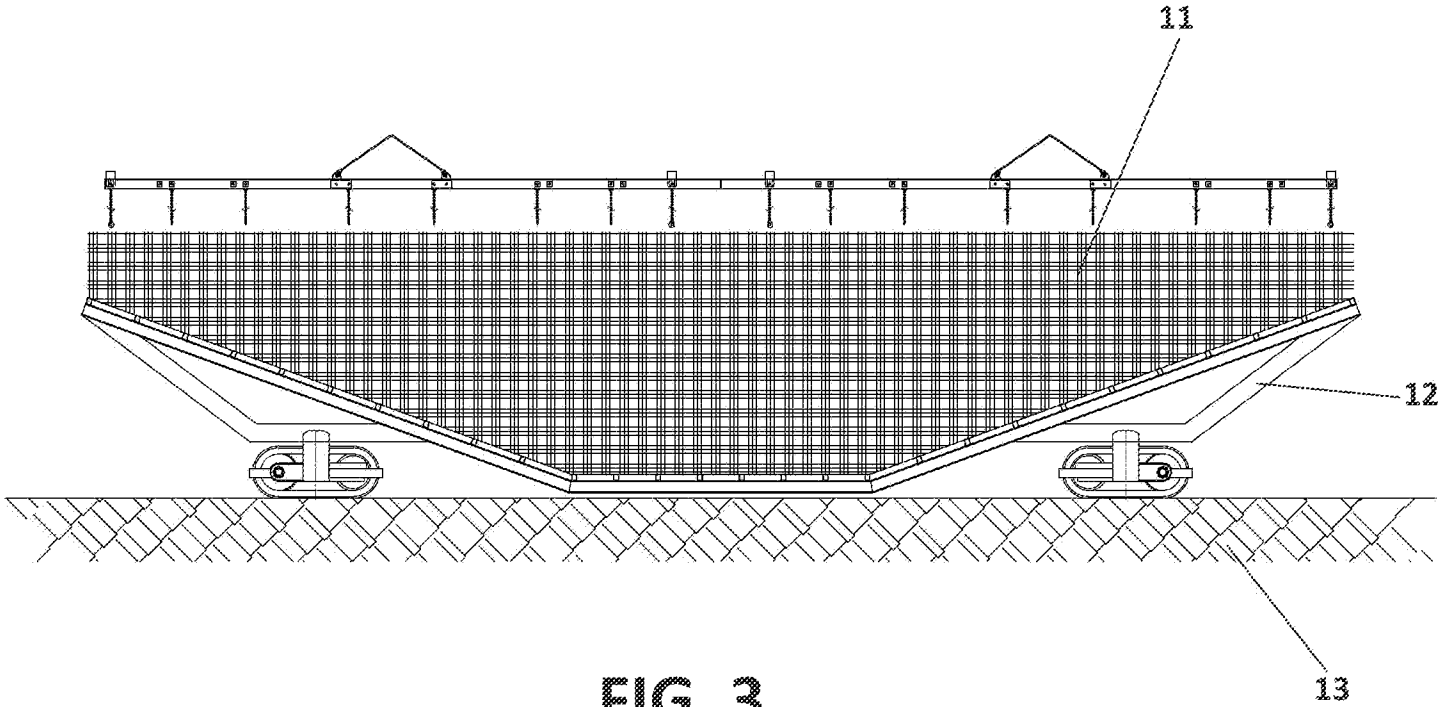
FIG. 3. shows a front elevational view of a rebar reinforcing cage and the ancillary rebar supporting wheeled frame.

FIG. 3 shows a rebar reinforcing cage (11) resting on a wheeled frame (12) in turn resting on the ground (13).

Figure 4:
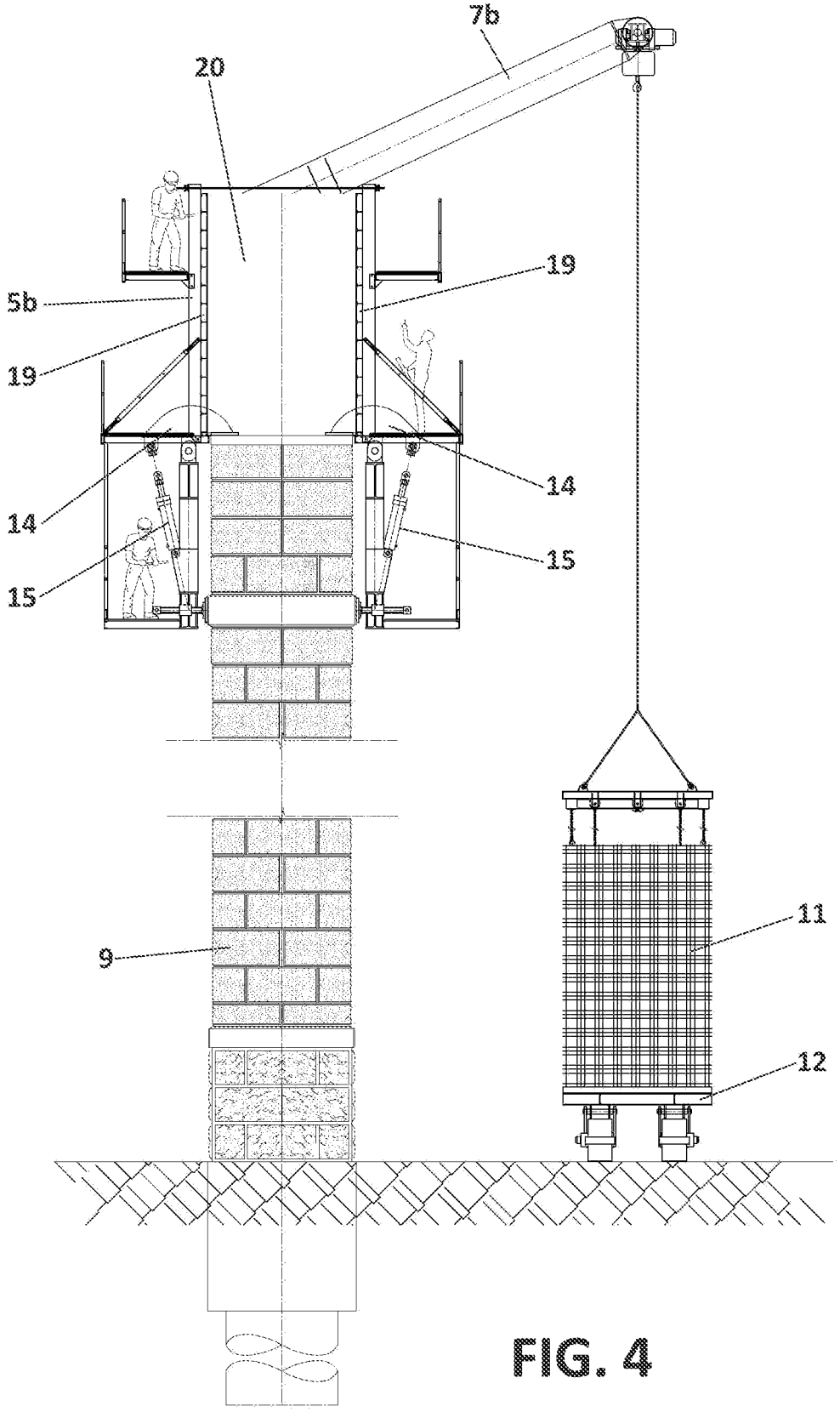
FIG. 4. shows a side elevational view with the rebar reinforcing cage on the ground, and the clamping means in the locked position as part of the process of assembling the formwork.
Figure 10:
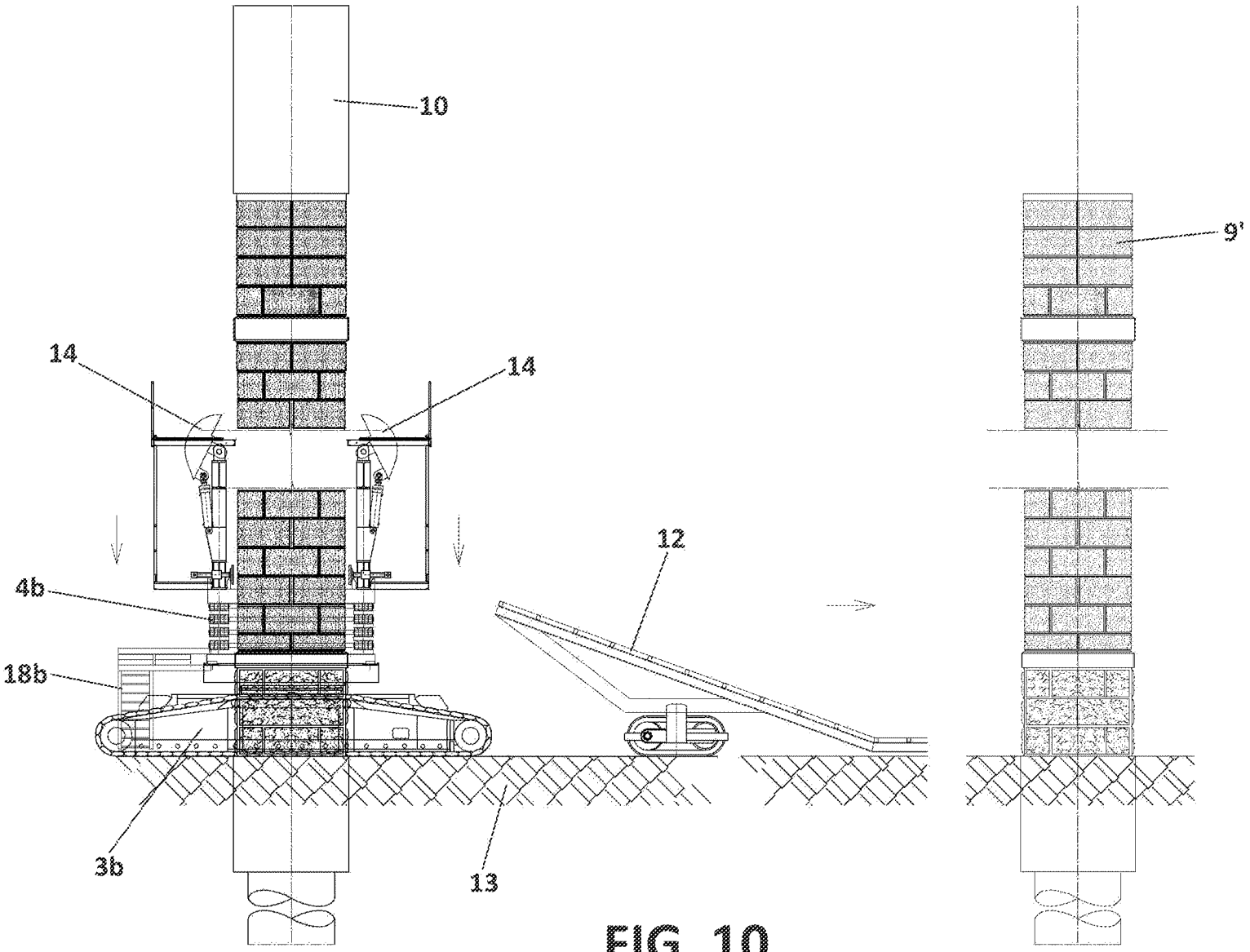
FIG. 10. shows a side elevational view of the representation of FIG. 9.
Figure 11:
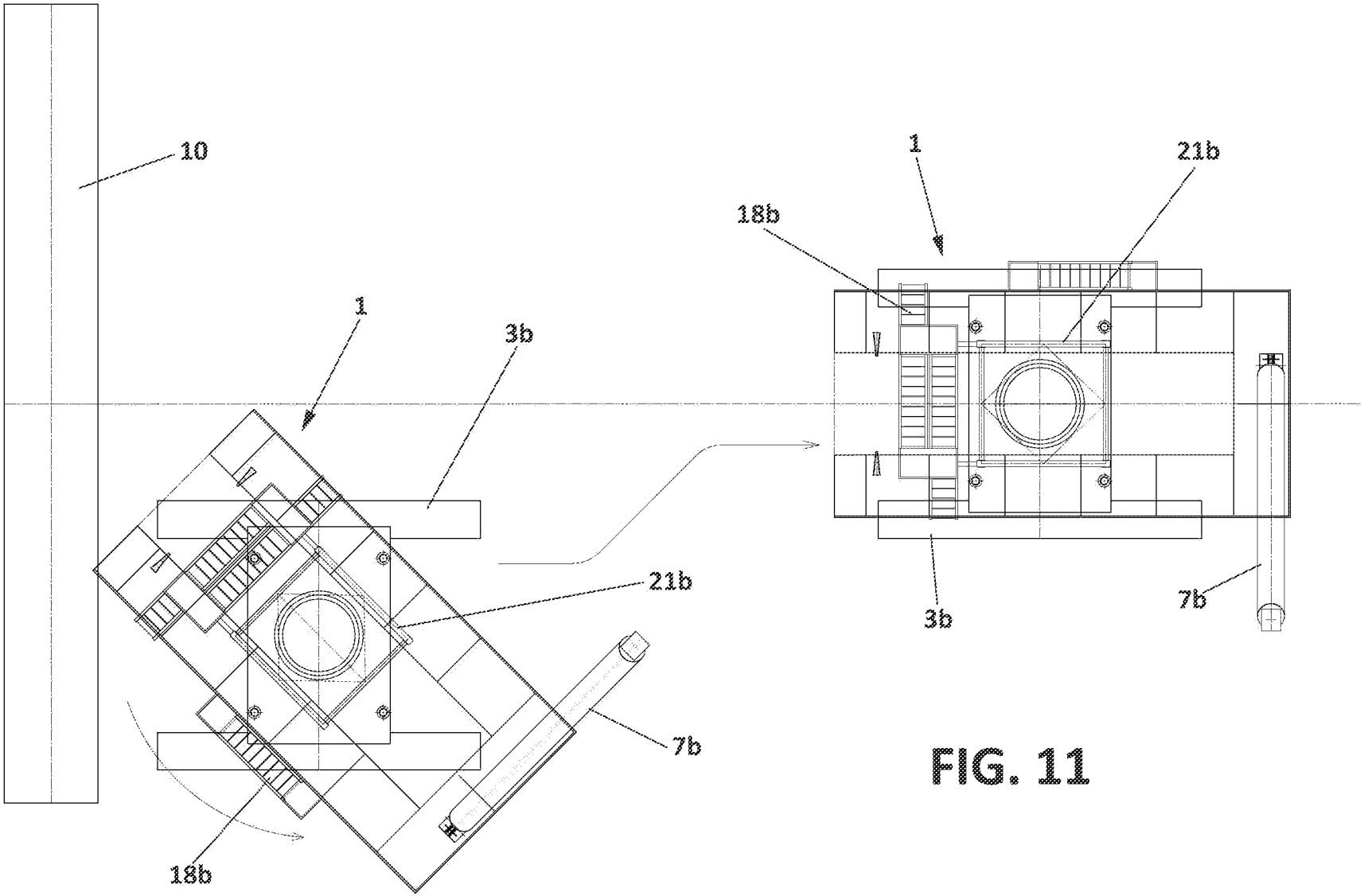
FIG. 11. shows a top plan view of a formwork machine that illustrate the capacity of the formwork supporting structure to rotate about an axis with respect to the vehicle, to maintain the centre of gravity of the machine with the tracks of the vehicle while the machine moves on inclined surfaces.
Figure 12:
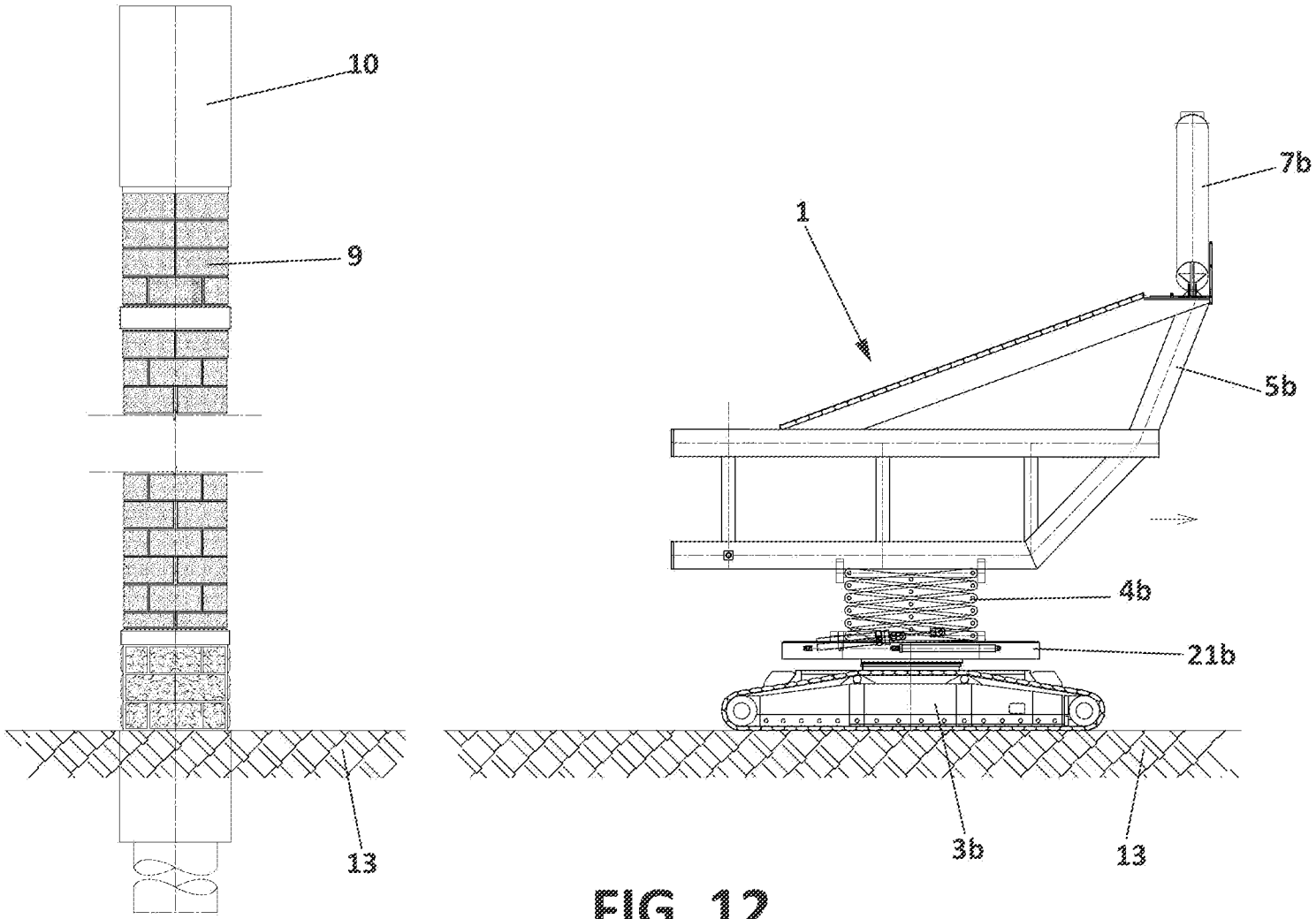
FIG. 12. shows a side elevational view of a formwork machine moving by itself to a next capital construction site.
Figure 13:
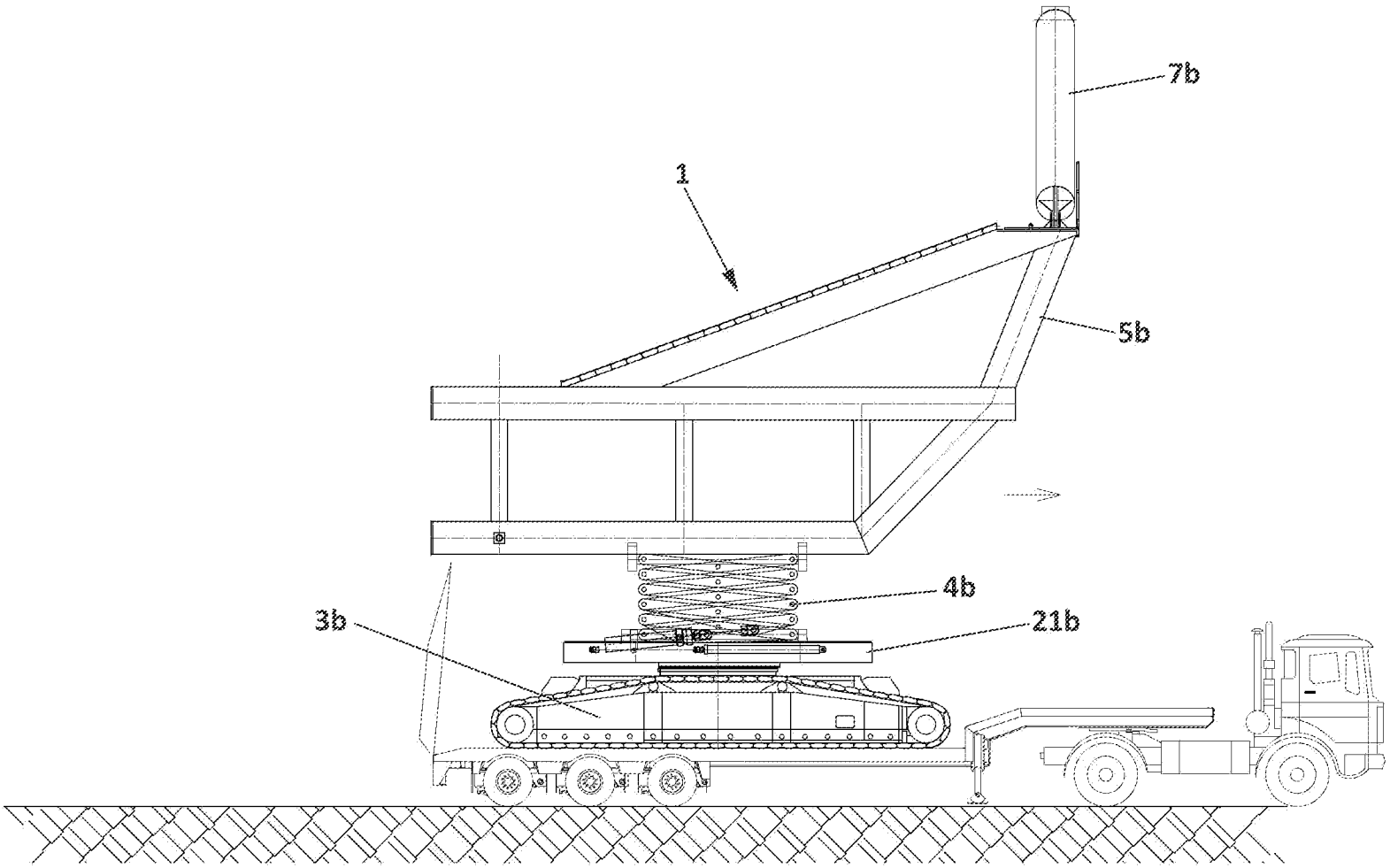
FIG. 13. shows a formwork machine being transported to a construction site by means of a gondola truck.

Each formwork machine (2*a*,2*b*) is fitted with coupling means configured for coupling the formwork supporting structures (5*a*,5*b*) with the top end of a pillar (9) preferably vertically installed in the ground (13). These coupling means are realized in this implementation, as clamping members (14) pivotally mounted in the formwork supporting structures (5*a*,5*b*), and operated by hydraulic cylinders (15) to pivotally move between a clamping position (shown in FIG. 4) in which the formwork supporting structures (5*a*,5*b*) are coupled with the pillar (9), and a released position (shown in FIG. 10) in which the formwork supporting structures (5*a*,5*b*) are uncoupled from the pillar (9).

Figure 5:
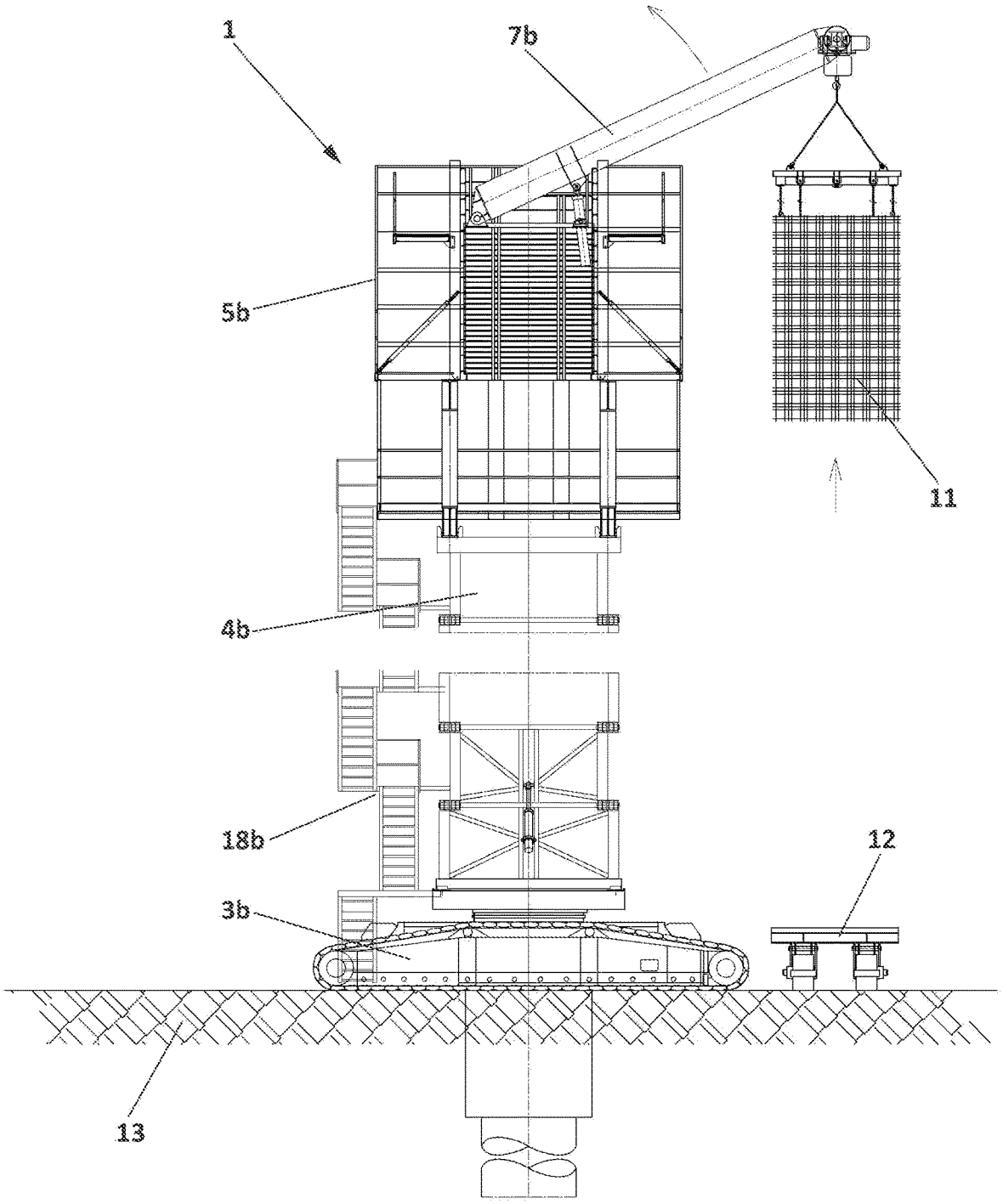
FIG. 5. shows a side elevational view of a formwork machine in its extended position and in the process of lifting a rebar cage.
Figure 6:
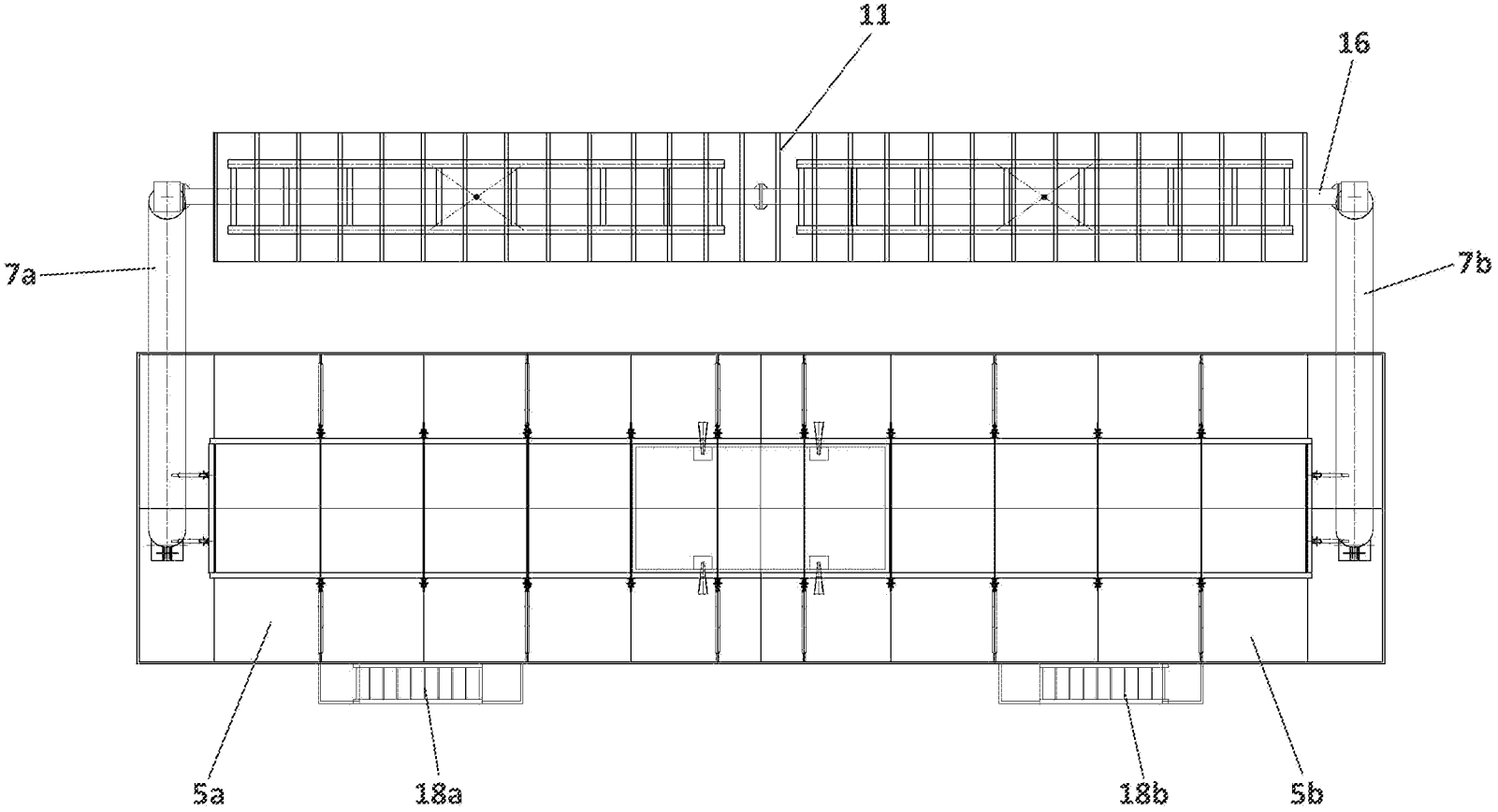
FIG. 6. shows a top plan view of the formwork machine of FIG. 5.
Figure 7:
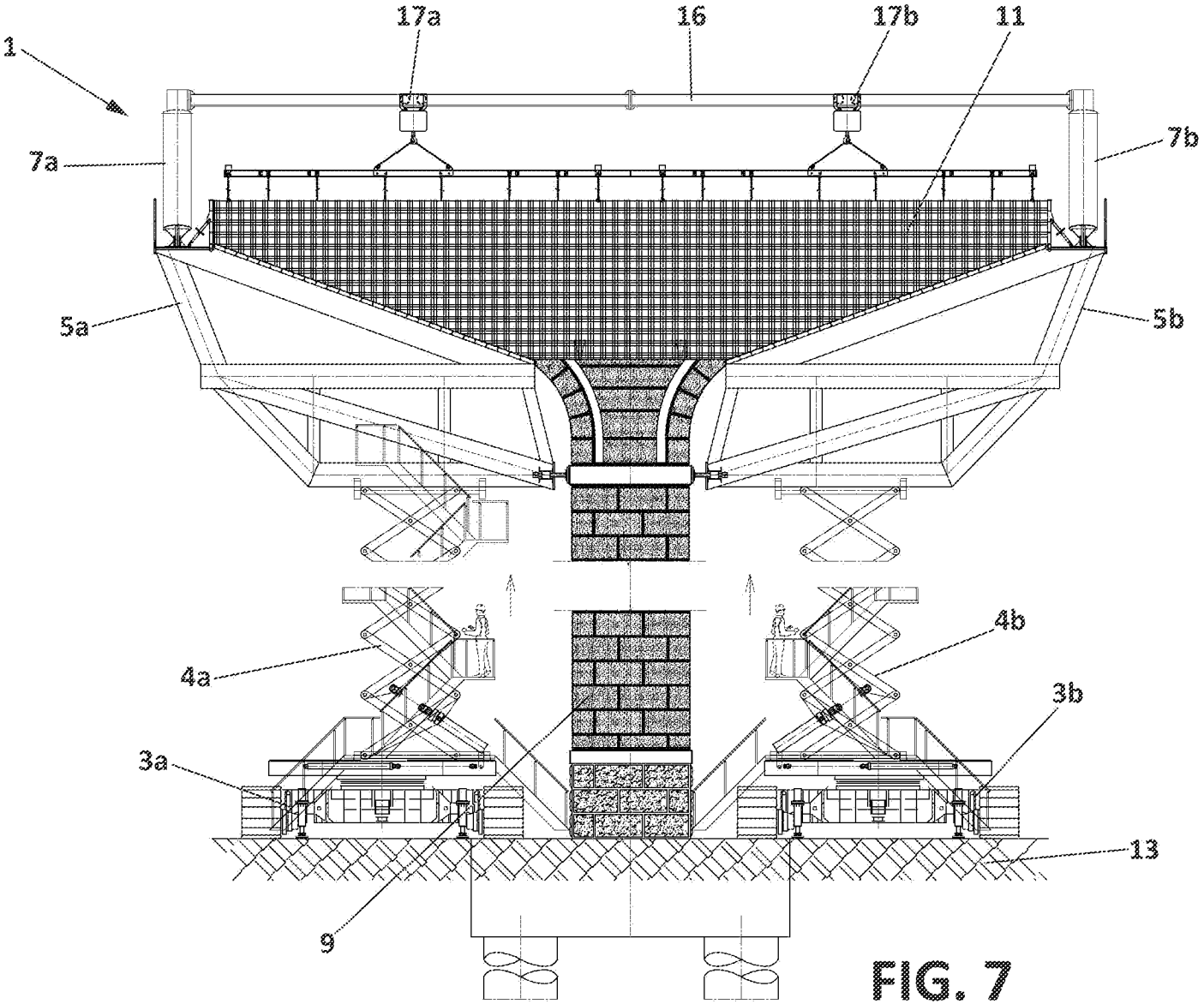
FIG. 7. shows a front elevational view of the formwork system coupled to a pillar with the two formwork machines in their extended position.

Additionally, each formwork machine (2*a*,2*b*) is provided with a ladder (18*a*,18*b*) formed by several ladder segments articulately joined between them, and coupled with the formwork supporting structures and the self-driven vehicles, as shown in FIG. 5, such that each ladder (18*a*,18*b*) is extendable and retractable together with the first and second extendable and retractable mechanisms (4*a*,4*b*). In addition, the steps of the ladder segments are articulated, so that the steps are always horizontal in any position of the extendable and retractable mechanisms (4*a*,4*b*).

The formwork supporting structures (5*a*,5*b*) can be coupled and uncoupled from the respective extendable and retractable mechanism (4*a*,4*b*), and the formwork supporting structures (5*a*,5*b*) are configured as self-supporting structure that can remain coupled by themselves to a pillar (9), once the formwork supporting structures (5*a*,5*b*) are uncoupled from the extendable and retractable mechanisms (4*a*,4*b*).

Figure 8:
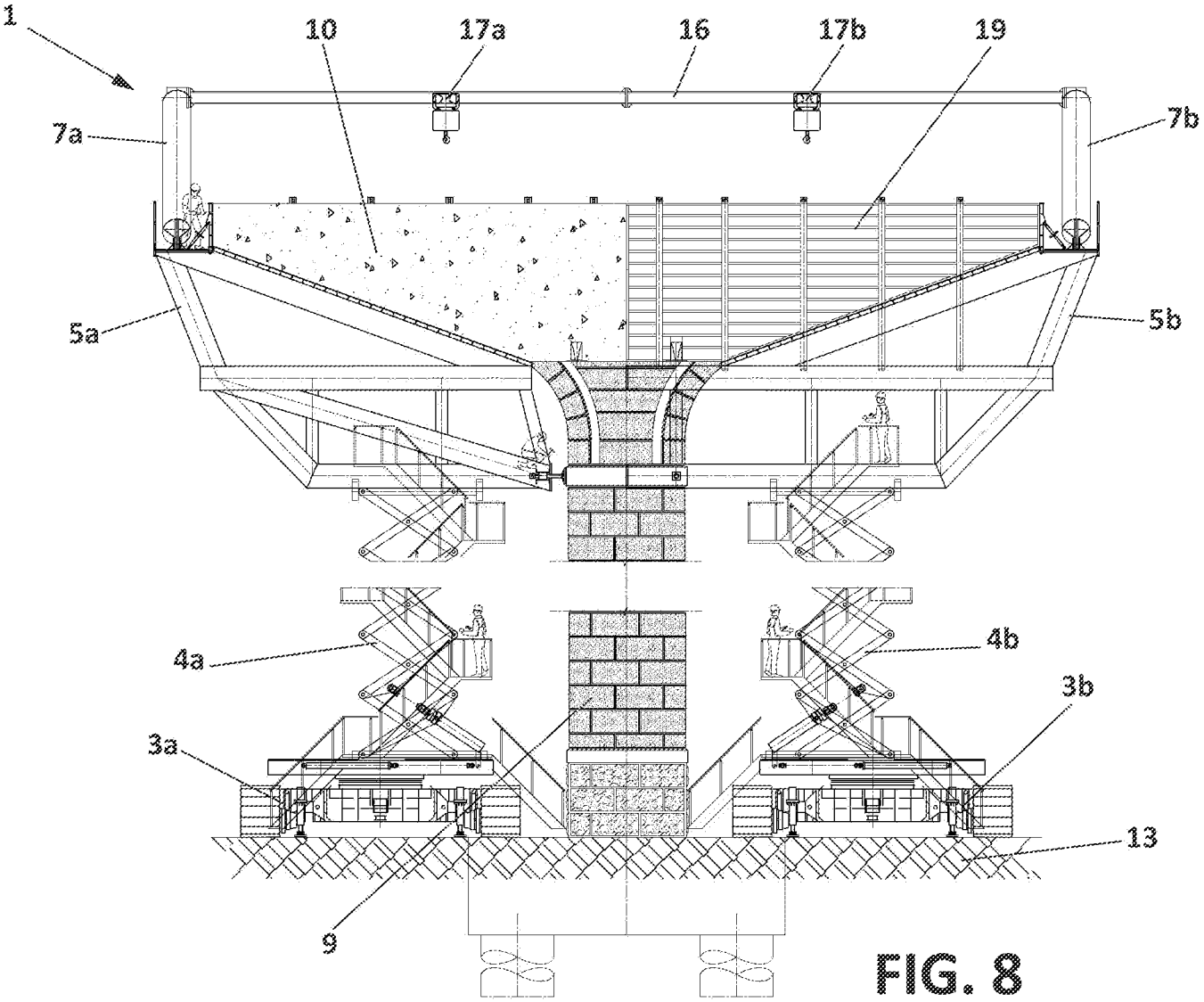
FIG. 8. shows a similar representation than FIG. 7.

As shown in FIG. 8, the formwork system comprises formwork panels (19) couplable to the formwork supporting structures (5*a*,5*b*) of the first and second formwork machines (2*a*,2*b*), when the first and second formwork machines (2*a*,2*b*) are coupled to a pillar (9) to configure a mould (20) having the shape of the capital (10) to be constructed.

Figure 9:
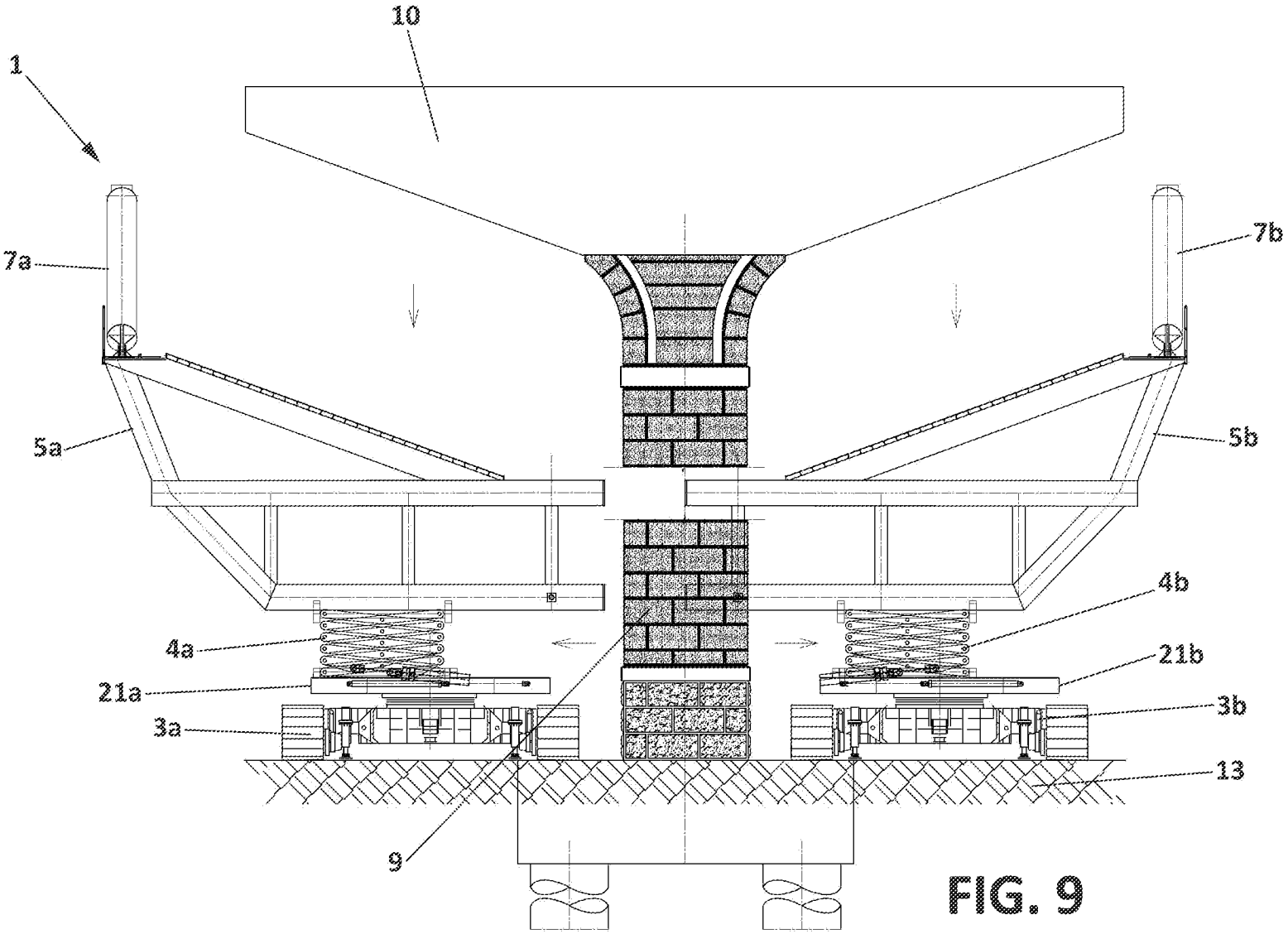
FIG. 9. shows a front elevational view with the formwork machines in their retracted position in the process of disassembling the formwork once a concrete capital has been formed.

Each of the first and second self-driven vehicles (3*a*,3*b*) has a horizontal platform (21*a*,21*b*), and the formwork supporting structure and the extendable and retractable mechanism are jointly movable sideways on the respective self-driven vehicle's platform, as indicated by the arrows in FIGS. 1 and 9, to facilitate the operation of coupling and uncoupling the formwork supporting structures (5*a*,5*b*) to the pillar (9). In particular, as represented in FIG. 9, once the capital has been formed, the two formwork supporting structures (5*a*,5*b*) are separated from each other, as to liberate the formwork system from the pillar (9) to be able to move it to the next construction site.

Furthermore, the formwork supporting structures (5*a*,5*b*) alone or together with the extendable and retractable mechanisms (4*a*,4*b*), are jointly rotatable about an axis orthogonal to ground (13), such that the formwork supporting structures (5*a*,5*b*) can be accurately positioned according to the curvature of the highway track.

What is claimed is:

1. A formwork system for constructing a capital on top of a pillar, the formwork system comprising:

a first formwork machine and a second formwork machine, each formwork machine in turn comprising:

a self-driven vehicle, an extendable and retractable mechanism mounted on the self-driven vehicle, a formwork supporting structure mounted on the extendable and retractable mechanism, such that the formwork supporting structure can be raised and lowered above the self-driven vehicle, wherein the formwork supporting structure is fitted with coupling means configured for coupling the formwork supporting structure with the pillar, and wherein the formwork supporting structure is configured as a self-supporting structure such that it can remain coupled by itself to the pillar after uncoupling the formwork supporting structure from the extendable and retractable mechanism, the formwork system further comprising:

formwork panels supported by the formwork supporting structures of the first and second formwork machines, when the first and second formwork machines are coupled to the pillar for forming the capital on top of the pillar, and a lifting system supported by the formwork supporting structure, wherein the lifting system is configured for lifting objects above the formwork supporting structure.

2. The formwork system of claim 1, wherein the formwork supporting structure is rotatable about an axis orthogonal to ground.

3. The formwork system of claim 1, wherein the formwork supporting structure and the extendable and retractable mechanism are jointly rotatable about an axis orthogonal to ground.

4. The formwork system of claim 1, wherein the formwork supporting structure can be coupled and uncoupled from the extendable and retractable mechanism.

5. The formwork system of claim 1, wherein the self-driven vehicle has a horizontal platform, and wherein the formwork supporting structure and the extendable and retractable mechanism are jointly rotatable on the self-driven vehicle's platform.

6. The formwork system of claim 1, wherein the self-driven vehicle is a tracked vehicle.

7. The formwork system of claim 1, wherein the lifting system comprises a davit operated by a hydraulic cylinder.

8. The formwork system of claim 1, wherein the lifting system comprises a first davit operated by a first hydraulic cylinder supported by the formwork supporting structure of the first formwork machine, and a second davit operated by a second hydraulic cylinder and supported by the formwork supporting structure of the second formwork machine.

9. The formwork system of claim 1, wherein the extendable and retractable mechanism is configured for raising and lowering the formwork supporting structure in a vertical direction parallel to an axis of the pillar, or in a direction with a vertical component.

10. The formwork system of claim 9, wherein the extendable and retractable mechanism is a scissor lift operated by a hydraulic cylinder.

11. The formwork system of claim 1, wherein the coupling means for coupling the formwork supporting structure with the pillar are clamping members pivotally mounted in the formwork supporting structures and operated by hydraulic cylinders to pivotally move between a clamping position in which the formwork supporting structures are coupled with the pillar and a released position in which the formwork supporting structures are uncoupled from the pillar.

* * * * *